US006899178B2

(12) United States Patent
Tubel

(10) Patent No.: US 6,899,178 B2
(45) Date of Patent: May 31, 2005

(54) METHOD AND SYSTEM FOR WIRELESS COMMUNICATIONS FOR DOWNHOLE APPLICATIONS

(76) Inventor: Paulo S. Tubel, 118 E. Placid Hill, The Woodlands, TX (US) 77381

( * ) Notice: Subject to any disclaimer, the term of this patent is extended or adjusted under 35 U.S.C. 154(b) by 0 days.

(21) Appl. No.: 10/381,766

(22) PCT Filed: Sep. 27, 2001

(86) PCT No.: PCT/US01/30229

§ 371 (c)(1),
(2), (4) Date: Mar. 28, 2003

(87) PCT Pub. No.: WO02/27139

PCT Pub. Date: Apr. 4, 2002

(65) Prior Publication Data

US 2003/0192692 A1 Oct. 16, 2003

Related U.S. Application Data

(60) Provisional application No. 60/236,245, filed on Sep. 28, 2000.

(51) Int. Cl.[7] ..... E21B 47/00

(52) U.S. Cl. ..... 166/313; 166/52; 166/53; 166/66.6

(58) Field of Search ..... 166/313, 52, 53, 166/65.1, 66.4, 66.6, 369, 50

(56) References Cited

U.S. PATENT DOCUMENTS

| | | | | | |
|---|---|---|---|---|---|
| 5,732,776 | A | * | 3/1998 | Tubel et al. | 166/250.15 |
| 5,868,201 | A | * | 2/1999 | Bussear et al. | 166/53 |
| 5,941,307 | A | * | 8/1999 | Tubel | 166/313 |
| 5,975,204 | A | | 11/1999 | Tubel et al. | |
| 6,442,105 | B1 | | 8/2002 | Tubel et al. | |

* cited by examiner

*Primary Examiner*—William Neuder
(74) *Attorney, Agent, or Firm*—Duane Morris LLP

(57) ABSTRACT

The present invention comprises tools (20) for deployment downhole in a wellbore for aiding in the production of hydrocarbons. In an exemplary embodiment, the tools (20) comprise a tool body (24); an electrically powered device (22) disposed proximate the tool body (24); a removable power source (26) for providing power to the device disposed in the tool body (24), the power source connected to or mounted into or about the tool body (24), the power source (26) further being fixed or replaceable downhole; and a wireless communications device (57) operatively connected to the electrically powered device.

29 Claims, 3 Drawing Sheets

METHOD AND SYSTEM FOR WIRELESS COMMUNICATIONS FOR DOWNHOLE APPLICATIONS

CROSS REFERENCE TO RELATED APPLICATIONS

The present inventions claim priority from United States Provisional Application No. 60/236,245 filed Sep. 28, 2000, incorporated by reference herein.

BACKGROUND OF THE INVENTION

1. Field of the Invention

The present inventions relate to the field of wireless communications. More specifically, the present inventions, in exemplary embodiments, relate to wireless communications with tools and gauges deployed downhole in a hydrocarbon well.

2. Description of the Related Art

The complexity and cost of exploring for and producing oil and gas has increased significantly in the past few years. New challenges for drilling, completing, producing, and intervening in a well, environmental regulations, and wide swings in the price of oil have all changed the role of technology in the oil fields. The industry is relying on technology to affect the costs of exploring for hydrocarbons in the following ways:

- Reduce operating expenses by automating the processes used to explore and produce hydrocarbons, reducing the frequency of unplanned intervention, and improving information and knowledge management to decrease operating inefficiencies.
- Increase net present value by providing systems that will enhance the recovery of hydrocarbons from reservoirs and that will improve production techniques.
- Reduce capital expenditures by creating processes that will decrease the number of wells drilled and that will also reduce the number of surface facilities and the amount of equipment required to handle larger quantities of hydrocarbons at those facilities.

In response, new processes for drilling, completion, production, hydrocarbon enhancement, and reservoir management have been created by advancements in technology in fields such as high-temperature sensory, downhole navigation systems, composite materials, computer processing, speed and power, software management, knowledge gathering and processing, communications and power management.

The ability to communicate in and out of the wellbore using wireless systems can increase the reliability of completion systems and decrease the amount of time required for the installation of completion hardware in a wellbore. By way of example and not limitation, the elimination of cables, clamps, external pressure and temperature sensors, as well as splices on the cable that can fail inside the wellbore, may provide a significant advantage when attempting to place tools and sensors in horizontal sections of a well that has separate upper and lower completion sections.

Intelligent completions systems are now playing an important role in the remote control of the hydrocarbon flow. These systems have shown to be able to save a significant amount of money by decreasing unscheduled interventions in the wellbores as well as being able to optimize production. Integration of sensors and flow control with wireless communications and downhole power generation may change the way hydrocarbons are produced from the wellbore. By way of example and not limitation, the ability to place multiple intelligent completion systems in laterals without worrying about cable or hydraulic line deployment will give the ability to control production from horizontal sections of the wellbore and prevent the premature watering due to production only from the heel of the lateral instead of the entire lateral.

As used in the prior art, "Intelligent Well Completions" is understood to mean a combination of specialized equipment that is placed downhole (below the wellhead) to enable real time reservoir management, downhole sensing of well conditions, and remote control of equipment. Thus, "intelligent completions" include products and associated services which optimize the productive life of an oil or gas well through devices which either provide information to the operator at the surface for the purpose of enabling the operator to conduct intervention operations as necessary, or which regulate the well flow on some controlled basis, without the necessity of re-entering the well. Examples of "Intelligent Well Completions" are shown in U.S. Pat. No. 6,247,536 (Leismer et al.); U.S. Pat. No. 5,829,520 (Johnson); U.S. Pat. No. 5,207,272 (Pringle et al.); U.S. Pat. No. 5,226,491 (Pringle et al.); U.S. Pat. No. 5,230,383 (Pringle et al.); U.S. Pat. No. 5,236,047 (Pringle et al.); U.S. Pat. No. 5,257,663 Pringle et al.); and U.S. Pat. No. 5,706,896 (Tubel et al.). Some key features of intelligent completion systems include:

- Power and telemetry cabling that provides a link between surface computer and downhole actuators
- Downhole modules that measure pressure, temperature, and flow rate in the tubing and annulus
- Surface units that monitor and request downhole data transfer on a periodic basis
- Surface units that actuate downhole devices to optimize production parameters Because of hostile conditions inherent in oil wells, and the remote locations of these wells—often thousands of feet below the surface of the ocean and many miles offshore—traditional methods of controlling the operation of downhole devices may be severely challenged, especially with regard to electrical control systems.

For these reasons, reliability of systems operating in oil wells is of paramount importance, to the extent that redundancy is required on virtually all critical operational devices.

A wireless transmission tool provides the ability to communicate without wire media through the production tubing, such as by using fluid inside the wellbore and/or in geological formations through which the tubing passes. A system using such tools may be used to provide pressure/temperature information from inside the wellbore that is transmitted at predetermined intervals that may programmed before or after the tool is inserted in the well.

Acoustic wireless communications does not disrupt the flow of production fluids. Further, as the signals arc carried wirelessly such as by stress waves in production tubing, the data is virtually unaffected by the fluid in the well and data transmission is virtually unaffected by vibration in the wellbore such as by vibrations caused by artificial lift pumps.

Accordingly, there is a need for intelligent structures deployed downhole to aid with production of fluids, such as hydrocarbon fluids and gasses, where transmission of data to and from the tool is accomplished wirelessly.

BRIEF DESCRIPTION OF THE DRAWINGS

These and other features, aspects, and advantages of the present inventions will become more fully apparent from the following description, appended claims, and accompanying drawings in which:

DETAILED DESCRIPTION OF THE PREFERRED EMBODIMENT

In general, throughout this description, if an item is described as implemented in software, it can equally well be implemented as hardware.

Although the oil and gas industry is used for exemplary reasons herein, the present inventions' features and improvements apply to many fields including, by way of example and not limitation, nuclear facilities, refineries and other areas are not easily accessed.

Figure 1:
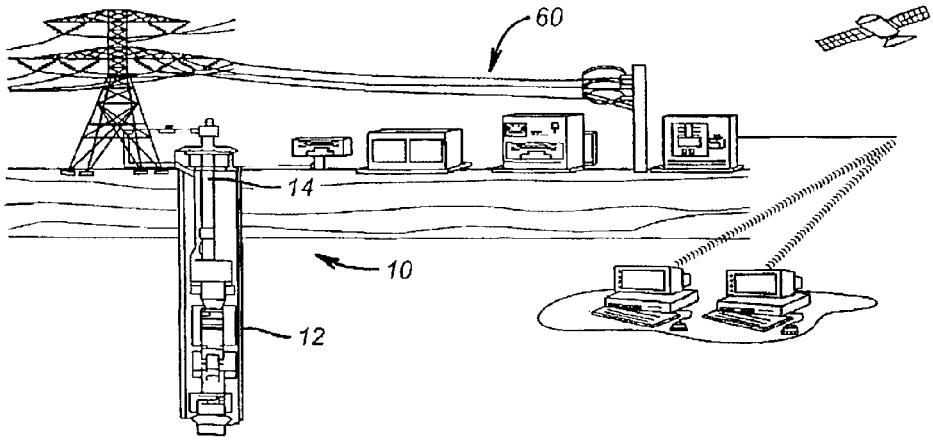
FIG. 1 is a schematic of an exemplary hydrocarbon configuration of the present invention.

Referring now to FIG. 1, an exemplary hydrocarbon well is shown at 10. As will be readily understood by those of ordinary skill in the hydrocarbon drilling arts, tubing such as at 12 is deployed in well 10 and production tubing 14 is deployed in casing 12. A wireless tool 20 is attached to production tubing 14. At a surface location 50, data processor 60 and data transceiver 55 are located, comprising data acquisition capabilities such as at data processor 60. Data processor 60 may be connected to data transceiver 55 in many ways as will be familiar to those of ordinary skill in the data communications arts, by way of example and not limitation comprising cables, wires, infrared, LED, microwave, acoustic, and the like, or combinations thereof.

Figure 1A:
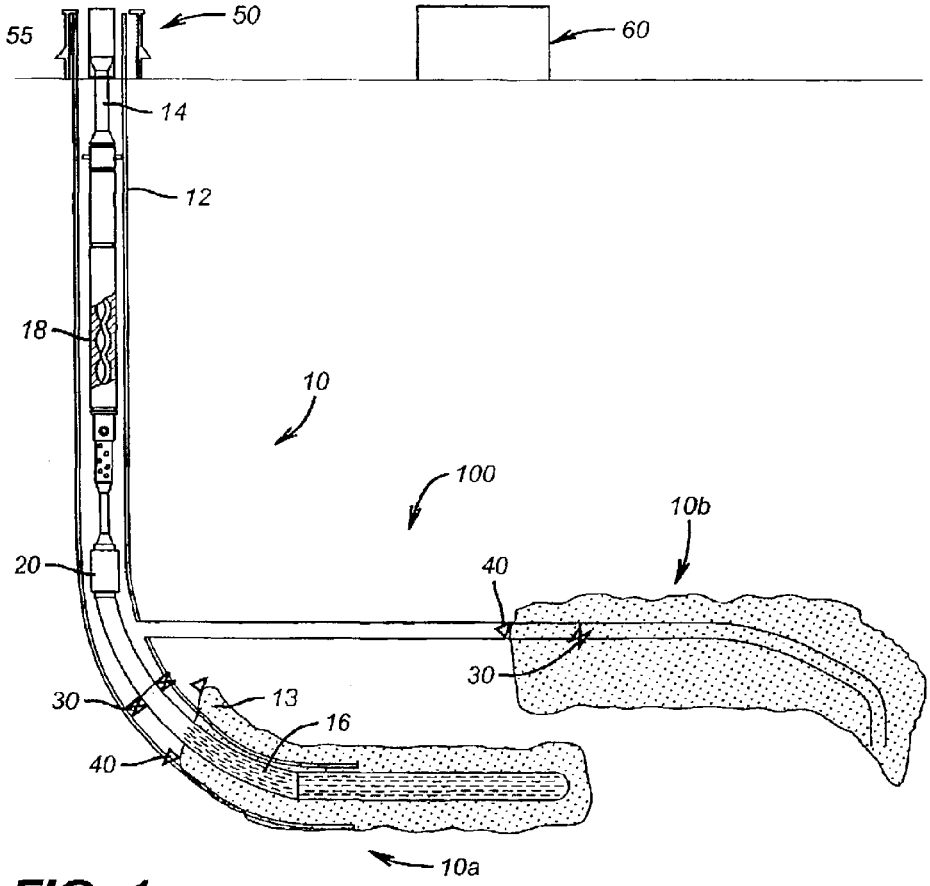
FIG. 1*a* is a schematic of an exemplary hydrocarbon configuration of the present invention.

Referring now additionally to FIG. 1*a*, a partial cutaway schematic of an exemplary embodiment, as used herein, "transceiver" includes both data receivers and data transceivers, as those terms are familiar to those of ordinary skill in the data transmission arts. By way of example and not limitation, in FIG. 1*a* a progressive cavity pump is shown at 18 as an exemplary tool that may also be present downhole and that may or may not be a wireless tool 20. In this example, wireless tool 20 may be deployed above progressive cavity pump 18 permanently if there is continuous tubing 12 from the bottom of progressive cavity pump 18 to wireless tool 20.

Sensors 30 and gauges 40 may be deployed at predetermined locations in wellbore 10. Additionally, liner 16 may be deployed in a lower completion area of wellbore 10. In a preferred embodiment, because gauges 40 may be embedded in a wireless tool 20 or sensor 30, these wireless tools 20 and sensors 30 may themselves be embedded in liner 16 such as to monitor pressure drop through liner 16. However, in some situations wireless tool 20 may be larger than placement in liner 16 will permit. By way of example and not limitation, wireless tool 20 may be of such a size as to require a larger hole to be drilled or a smaller liner 16 to be deployed in wellbore 10 to accommodate a diameter of wireless tool 20. These may not be acceptable alternatives. Accordingly, one or more gauges 40 may detached from wireless tool 20 and deployed separately in liner 16 of wellbore 10. Gauges 40 deployed in liner 16 may then be connected to one or more other gauges such as by a TEC cable back to wireless tool 20 or sensor 30.

Multiple wireless tools 20, sensors 30, and gauges 40 may be deployed in tubing 12, and each such wireless tool 20, sensor 30, and gauge 40 may use a different data transmission frequency, e.g. participate in a broadband transmission scheme. Alternatively, each such wireless tool 20, sensor 30, and gauge 40 may have a unique data address such as in a single channel mode transmission scheme such as with collision detection protocols, although broadband transmission devices may also have unique data addressing. In further alternative embodiments, two way communications may be accomplished using master/slave data communications wherein data transceiver 55 is located at the surface of the well and acts as the master and wireless tool transceiver 57 is located proximate wireless tool 20.

Accordingly, various physical characteristics of wellbore 12, the surrounding formation, and the fluids within or proximate to tubing 14 may be sensed, measured, and relayed to data processor 60 or other devices located in wellbore 10. The physical characteristics may comprise temperature and pressure both inside and outside of liner 16 and/or tubing 14 as well as flow of materials, e.g. hydrocarbons, through tubing 14.

Wireless data communications may be either one way or bi-directional and may be accomplished using any wireless transmission method, by way of example and not limitation including acoustic waves, acoustic stress waves, optical, electro-optical, electrical, electromechanical force, electromagnetic force ("EMF"), or the like, or a combination thereof, through at least one wireless transmission medium, by way of example and not limitation including a wellbore pipe, drilling mud, or production fluid. As is known in the art, wireless data transmission through tubing 14 does not disrupt the flow of production fluids. Further, such transmission is substantially unaffected by fluid or vibration in wellbore 10. In a currently preferred embodiment, the data rate may ranges from one tenth to twenty thousand bits per second with a preferred rate of around ten bits per second. Additionally, data may be sent in bursts with predetermined quiescent periods between each data transmission.

In a currently preferred embodiment, acoustic signaling is used such as at wireless tool transceiver 57. By way of example and not limitation, acoustic telemetry devices do not block fluid paths in the production string, allowing for full bore access; acoustic systems transmit at frequencies that are unaffected by pump noise allowing for simple and low cost surface systems; and acoustic systems work with low power requirements such as those satisfied by battery power, thus providing some immunity to lighting and other potential problems at the surface. In a preferred embodiment, piezo wafers are used are used to generate an acoustic signal. In addition, magneto-restrictive material may also be used to generate acoustic wave signaling.

An entire wireless system comprising one or more of the present inventions may be placed below an upper completion area of wellbore 10 and would not require additional hardware to transmit data to surface 50. By way of example and not limitation, no special additional hardware would be required if tubing 14 was used as the transmission medium. However, in additionally contemplated embodiments, one or more repeaters (not shown in the Figures) may be placed downhole or along the data communications pathway between wireless tool transceiver 57 and surface data transceiver 55.

Figure 2A:
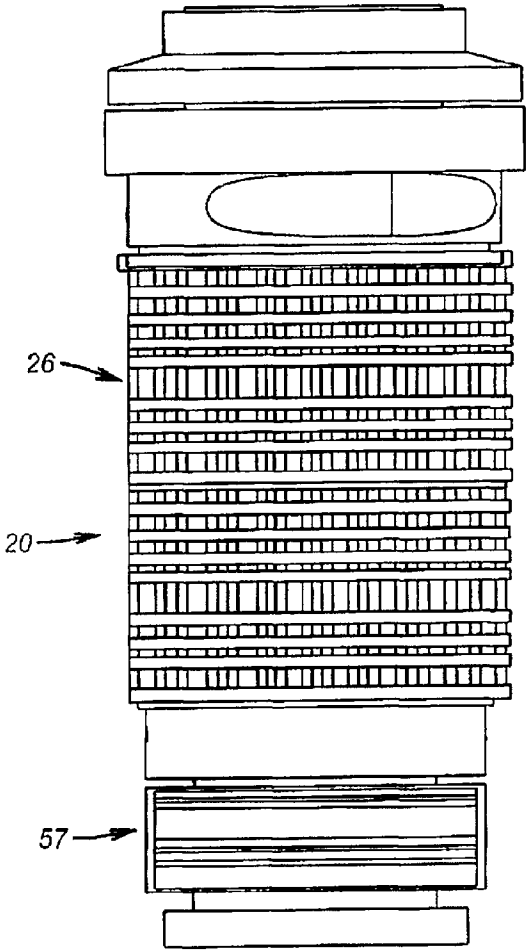
FIG. 2*a* is a second partial cutaway planar view of an exemplary embodiment of a wireless tool of the present invention.
Figure 2:
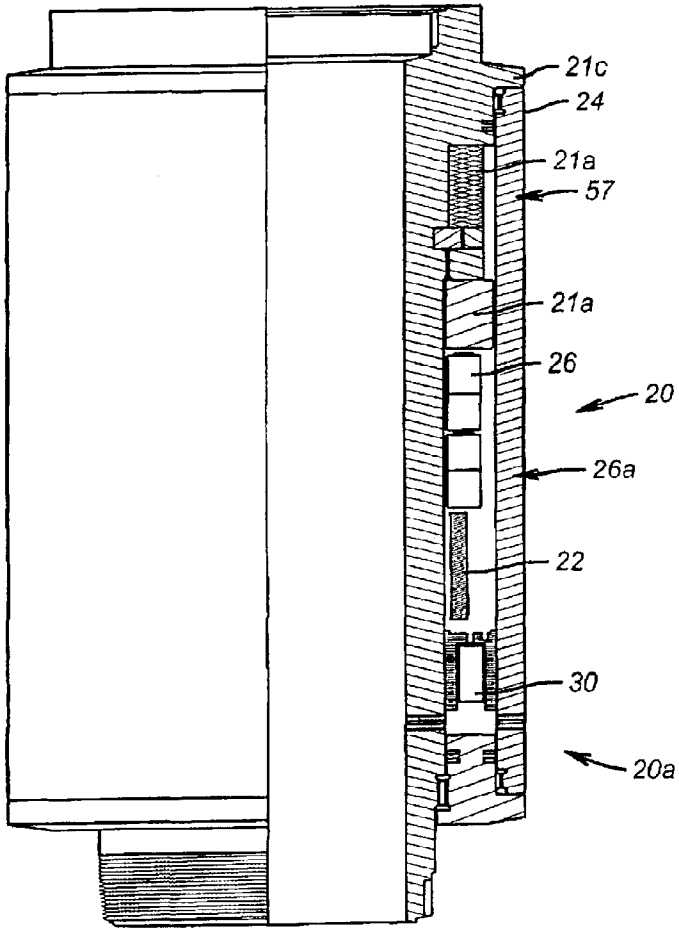
FIG. 2 is a partial cutaway planar view of an exemplary embodiment of a wireless tool of the present invention.
Figure 3:
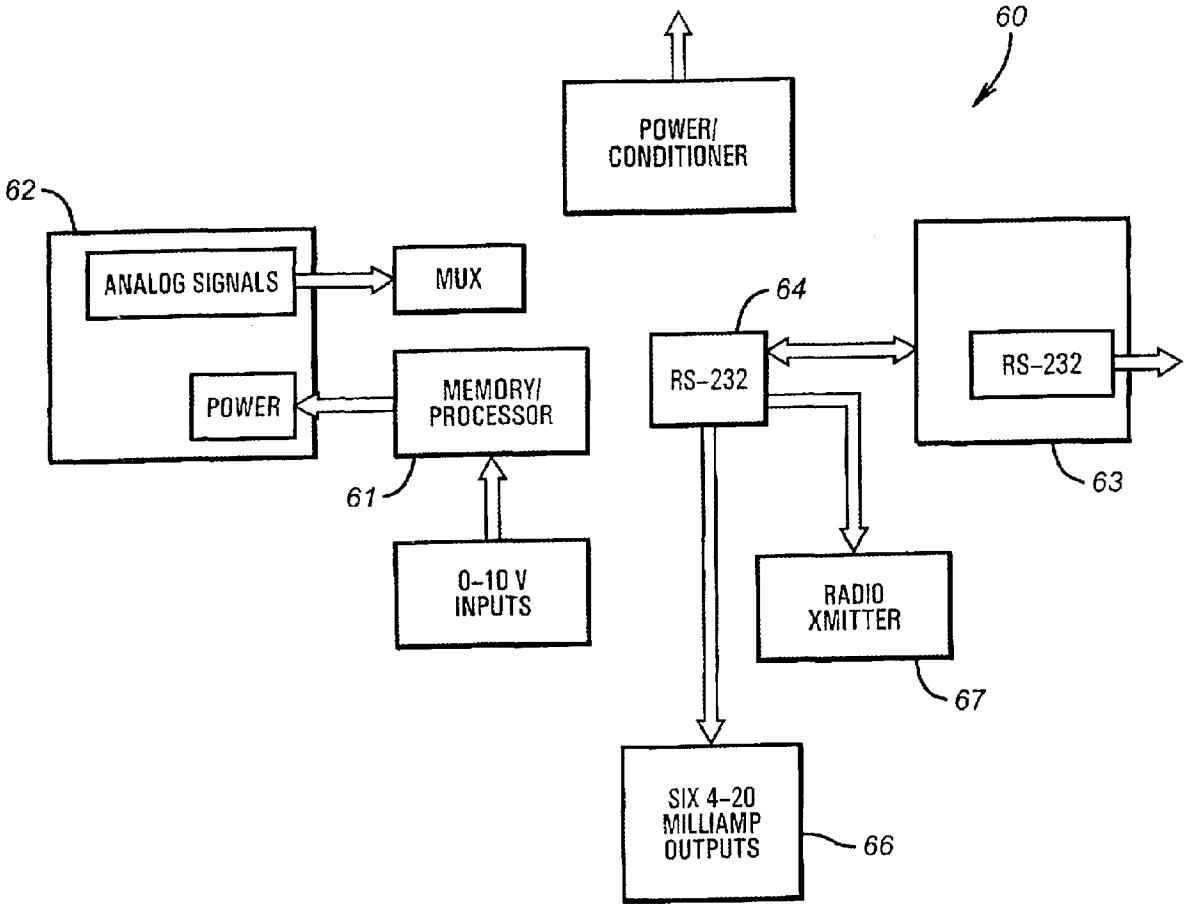
FIG. 3 is a block diagrammatic schematic of an exemplary SCADA system of the present invention.

Referring, now to FIG. 2 and FIG. 2*a*, in a preferred embodiment, wireless tool 20 comprises a tool body 24 having wireless tool transceiver 57 to facilitate wireless transmission of data such as to surface transceiver 55 and, optionally, to data processor 60. In a currently preferred embodiment, wireless tool transceiver 57 comprises transformer 21*a*, crystal 21*b*, and acoustic transmitter mandrel 21*c*. Transformer 21*a* may be a split transformer having two approximately equal portions where transformer 21*a* is disposed about acoustic transmitter mandrel 21*c*.

Data acquisition module 22 may be disposed proximate the tool body (24), by way of example and not limitation such as in a recess of tool body 24. Data acquisition module 22 is operatively connected to wireless tool transceiver 57 and obtains data from sensors 30 and gauges 40 (not shown in FIG. 2) which may be embedded in or located apart from wireless tool 20. Volatile or non-volatile memory may be provided to store data, either from sensors 30 or gauges 40 or processed data to be transmitted further such as a buffer for processed data when transmission rates are slower than data accumulation and processing rates. In a currently preferred embodiment, 500 KB of random access memory is provided.

Additionally, each wireless tool 20 may be uniquely addressable and identifiable, not only as a source of data but as an active device to facilitate controls of downhole processes.

Wireless tools 20 may comprise sensors 30, either in whole or in part. Sensors 30 may comprise fiber optic sensors 30 such as oil sensors, water sensors, and gas contents sensors. Sensors 30 are capable of monitoring at least one of chemical, mechanical, electrical or heat energy located in an area adjacent sensor 30, by way of example and not limitation including pressure, temperature, fluid flow, fluid type, resistivity, cross-well acoustics, cross-well seismic, perforation depth, fluid characteristics, logging data, or vibration sensors. By way of example and not limitation, sensors 30 may be magnetoresistive sensors, piezoelectric sensors, quartz sensors, fiber optics sensors, sensors fabricated from silicon on sapphire, or the like, or combinations thereof. Additionally, sensors 30 may be located within wireless tool 20 or proximate to wireless tool 20 and attached via a communications link such as a cable, where the cable may further provide power to sensor 30.

Gauges 40 may be connected to a wireless tool 20 or a sensor 30 such as by a wire where the wire may provide power to gauge 40 as well as provide a data communications pathway between gauge 40 and the device to which gauge 40 is attached, e.g. wireless tool 20 or sensor 30. The wire may comprise TEC electrical or fiber optic cables. In a currently preferred embodiment, gauges 40 comprise ultra-stable sapphire pressure and temperature gauges, and flow meters.

Both wireless tools 20 and sensors 30 may further comprise a replaceable power source to power their electrically powered component devices. In a preferred embodiment, wireless tool 20 or sensor 30 may comprise lower section 26A. As is also indicated in FIG. 2*a*, lower section 26A may have an opening or otherwise be recessed from tool body 24. One or more batteries 26 may be located either outside proximate wireless tool 20 or sensor 30 or fitted into or proximate lower section 26A. Battery 26 may be of any appropriate type but a lithium battery capable of withstanding high temperature environments. In a currently preferred embodiment, battery 26 has a life expectancy of around three years. If battery 26 is depleted, battery 26 may be replaced while wireless tool 20 or sensor 30 is still deployed downhole such as by using a side pocket mandrel to house battery 26 as will be known to those of ordinary skill in the downhole tool arts.

In a currently envisioned alternative embodiment, battery 26 may be replaced or augmented by a downhole power source such as a turbine (not shown in the Figures) which will be of a type familiar to those of ordinary skill in the down hole arts such as used in measurement while drilling (MWD) applications in the drilling sector of the oil and gas industry. The turbine is able to operate in environments such as are found inside a hydrocarbon well and provides the power for wireless system components 20,30,40. In alternative embodiments, power generation located downhole, may comprise piezoelectric power generation devices and magneto-restrictive power generation devices in addition to turbines and batteries.

In the operation of an exemplary embodiment, wireless tools 20, sensors 30, and gauges 40 may be used to increase reliability of systems deployed downhole such as completion systems, by way of example and not limitation by reduction if not elimination of cables, clamps, external sensors 30 such as pressure and temperature sensors 30, as well as splices on signal cable that can fail inside wellbore 10 when attempting to place sensors 30 in horizontal sections of wellbore 10 that have separate upper and lower completions.

Wireless tools 20, sensors 30, and gauges 40 are deployed downhole in wellbore 10 according to the teachings of the present invention. Once deployed, data are gathered regarding at least one predetermined downhole parameter as well as the health of one or more tools located downhole and transmitted back to data processor 60 in a wireless manner according to the teachings of the present invention, e.g. use of a wireless data transceiver at the surface to communicate with wireless tool 20. Wireless components 20,30,40 may provide data independently or wait for a command from data processor 60 to start sending data back to data processor 60. As will be familiar to those of ordinary skill in the arts, the commands may comprise control directives to start data transmission to the surface, to wake up wireless tool 20, to change a predetermined operating parameter in wireless tool 20, or shut down one or more devices located downhole to manage power inside the wellbore.

Data detected at data processor 60 may be filtered, by way of example and not limitation such as by using bandpass filters, and converted into digital format as will be familiar to those of ordinary skill in the data processing arts. Data gathered may be further processed to correct errors in transmission as will be familiar to those of ordinary skill in the data processing arts.

Once obtained, software such as SCADA software executing in data processor 60 may be used to perform control system functions and may use the data in controlling flow of hydrocarbon from the annulus of the well into production tubing, by way of example and not limitation including using the data to control flow of fluids and solids from the surface into the well downhole and to control flow of fluids and solids from a first portion of the well downhole to another portion of the well downhole such as for bit cutting injection or fluid injection. Additionally, the data may further comprise data reflecting conditions downhole, by way of example and not limitation comprising reservoir monitoring data obtained using pressure, temperature, and flow meters, where the data may further comprise build up and draw down test result data as well as comprise data useful for monitoring and controlling artificial lift pumps such as by controlling speed settings of the artificial lift pump to optimize or maximize production by maintaining an optimum fluid level during production. The artificial lift pump data may comprise data useful in determining whether the artificial lift pump is functioning properly, a state of bearings in the artificial lift pump, temperature characteristics of the artificial lift pump, and occlusion of the artificial lift pump.

Referring now additionally to FIG. 1*a*, by way of further example and not limitation, a wireless intelligent completion system may be implemented and used in multilateral well completions, e.g. well sections 10*a* and 10*b*, using the system and methods of the present invention, especially where electrical or other cables may be difficult if not impossible to deploy. Such a system may be further capable of controlling the flow of hydrocarbon from the geological formations into production tubing 14 without a need for without any special hardware such as wet connectors and feedthrough packers. The system may comprise the following components:

- flow control tools, such as electrically operated flow control tools that use a motor and gear box for moving a sleeve to control the flow of hydrocarbon;
- sensors 30 and gauges 40 comprising sapphire gauges, flow meters, and fluid identification gauges for formation and production parameters measurements;
- power packs located downhole comprising turbines and batteries to power predetermined wireless tools 20, sensors 30, and gauges 40;
- wireless communications modules comprising acoustic communications devices for bi-directional information transfer; and
- Supervisory Control and Data Acquisition (SCADA) control system such as data processor 60.

For certain operations, a SCADA control system data processor 60 may use data reflective of external casing packer inflation monitoring and testing to monitor curing of cement and proper sealing of the packer.

In multilateral wells, a plurality of wireless tools 20 may be deployed in a plurality of wellbores 10*a*, 10*b* of a multilateral downhole system and wireless communications between wireless tools 20 in the plurality of the wellbores enabled.

Flow control tools may be constructed using the principles of existing downhole sliding sleeves for allowing the flow of hydrocarbon from the annulus into tubing 12.

Sensors 30 may be located in an upper section of a wireless tool 20 or may be standalone. Further, sensors 30 may be operatively integrated into a downhole production monitoring system that may monitor pressure, temperature, and flow parameters and identify fluids present in or near tubing 14. Sensors may comprise optical sensors as described in PCT Application PCT/US01/41165 to Paulo S. Tubel, filed on 26 Jun. 2001 and incorporated herein by reference. By way of example and not limitation, sensors 30 may include an electroptical sensor that uses Fabry-Perot interference for the identification of the water and oil content.

By way of example and not limitation, gauges 40 may comprise pressure gauges such as sapphire gauges that may be used to monitor pressure in tubing 14 and annulus 13. Gauges 40 may have resolution that is appropriate for the downhole environment, by way of example and not limitation 24 bits of resolution may be used to produce a detectable range of from around 0.001 psi to around 10,000 psi. By way of example and not limitation, sapphire technology is currently a preferred embodiment because sapphire gauges provide accuracy substantially equivalent to quartz gauges but are not as sensitive to temperature variations.

A power source such as batteries 26 will be able to generate the electricity required to operate a downhole wireless system of the present invention. In a preferred embodiment, a turbine may provide primary or backup power adequate to enable wireless tools 20, sensors 30, and gauges 40 located downhole while additionally providing sufficient power to charge batteries 26. Accordingly, a wireless system comprising one or more of the present inventions will be able to provide power to its downhole components 20,30,40 using the turbine when there is flow in wellbore 10 and using batteries 26 when there is no flow in wellbore 10.

Wireless tools 20 that use acoustic transmission communicate through production tubing 12 using stress waves. The acoustic communications does not disrupt the flow of production fluids and since the signals are carried by stress waves in the production tubing, the data is virtually unaffected by the fluid in the well. The transmission is also not affected by vibration in the wellbore caused by artificial lift pumps. The signal transmitted to the surface is immune to wellbore conditions due to a unique communications encoding technique fully proven for oil field applications.

The transmission length inside wellbore 10 is directly related to the data transmission rate. If the data transmission rate falls below a certain level, signal strength may be increased to effect a higher data transmission rate. Further, a wireless system comprising one or more of the present inventions may be designed to transmit data over greater distances, by way of example and not limitation including distances to around 15,000 feet. Repeaters (not shown in the figures) may be used to facilitate reliable data transmissions.

A SCADA data processor 60 located at surface 50 may be used to provide control to wireless components 20,30,40 located downhole tool as well as acquire and process data received from inside the wellbore. The complete system may be ruggedized for oil field applications.

In an exemplary embodiment, a SCADA controller data processor 60 may comprise a data acquisition transceiver such as data transceiver 55, by way of example and not limitation an accelerometer-based data acquisition device, or be operatively connected to data transceiver 55. Data acquisition transceiver 55 may be located at or on the wellhead. Data acquisition transceiver 55 obtains acoustic data from wireless tool transceiver 57 such as via production tubing 12 and may be used to convert the analog data into an electrical digital signal. Data acquisition transceiver 55 is further connected to a processor unit, by way of example and not limitation a personal computer, to provide data processing, display, and user interfaces.

By way of example and not limitation, a wireless system comprising one or more of the present inventions ("WICS") may be used in the following applications:

- WICS may be used to deploy multiple tools in the same wellbore 10, by way of example and not limitation by using different transmission frequencies for each wireless component 20,30,40, by using unique addresses for each wireless component 20,30,40, or a combination thereof;
- WICS wireless components 20,30,40 may be placed in laterals or horizontal sections of wellbore 10 to control flow and optimize one or more hydrocarbon production processes, by way of example and not limitation including monitoring pressures to allow optimization of drawdown such as by slowing encroachment of water in a hydrocarbon producing stream;
- WICS wireless components 20,30,40 may be deployed in wells to control the flow from a single zone in wells where two zones are being produced, by way of example and not limitation by monitoring a first zone for water production and shutting in the first zone with WICS wireless components 20,30,40 while continuing production from a second zone; and WICS wireless components 20,30,40 may be used in injection wells to assure that fluid injected in the well reaches the proper zone to be stimulated, including deploying multiple WICS wireless components 20,30, 40 may be in a single injector well to control fluid injection in individual zones, such that the data processor may issue control directives to control injection of fluids and solids into the annulus or geological formations associated with the well based at least partially on the data obtained from the wireless tool.

WICS wireless components 20,30,40 may be used to provide new ways to collect data and transmit the information to surface 50. By way of example and not limitation:

wireless components 20,30 with or without built in gauges 40 may be deployed in liner 16 of a lower completion in wellbore 10, thus, combined with different transmission frequencies for each wireless components 20,30, allowing monitoring parameters such as pressure and temperature inside and outside liner 16 at different locations in the wellbore 10;

wireless components 20,30 with or without built in gauges 40 may be deployed anywhere in the well and used to monitor parameters inside the wellbore, including performance of artificial lift systems deployed in the wellbore;

Deployment of multiple wireless tool in a single production tubing. The ability to place multiple tools in the tubing string in the lower and upper completions will allow for monitoring of formation and production parameters at different depths throughout the wellbore;

wireless components 20,30 with or without built in gauges 40 and gauges 40 may be used to monitor short term processes such as gravel pack and fracturing and external casing packer settings. The system can be deployed in the work string and monitor multiple parameters inside the wellbore in real time. The information obtained at the surface can help evaluate the work being performed downhole and correct any potential problems prior to retrieving the work string to the surface; and wireless components 20,30 with or without built in gauges 40 and gauges 40 may be placed in laterals above the sand screens for monitoring the pressure drops through the screens. The system can be permanently deployed in the lower completion and does not require any additional hardware such as wet connectors or alignment subs to interface the upper and lower completions.

By way of example and not limitation, other applications where the present inventions may be used comprises situations where it is desirable to non-permanently deploy a tool in a wellbore. In these situations, the present inventions may be used for monitoring tasks to be performed in the wellbore where a monitoring tool is later returned to the surface, by way of example and not limitation comprising:

tools placed in a work string for well re-work, including temporary work, where once the re-work is completed the tool comes out of the well with the work string;

monitoring of fracture and mini fracture jobs where a tool is deployed in the work string and lowered in the wellbore for monitoring predetermined parameters such as pressure, temperature and flow;

drill stem tests (DST) where a tool is connected to DST pipe and lowered in the wellbore to monitor one or more predetermined parameters such as pressure occurring during and after perforations; and/or tools connected to gravel pack pipe that are then lowered into a wellbore for monitoring a predetermined parameter during and after a gravel pack operation.

It will be understood that various changes in the details, materials, and arrangements of the parts which have been described and illustrated above in order to explain the nature of this invention may be made by those skilled in the art without departing from the principle and scope of the invention as recited in the following claims.

What is claimed is:

1. A system for wireless transmission of data in a wellbore (10) comprising:

a. a substantially wireless transmission medium (14);

b. a wireless tool (20) located at a predetermined position downhole, the tool (20) useful for monitoring a hydrocarbon reservoir in a target formation, the tool (20) further comprising:

i. a tool body (24);

ii. a power source (26), the power source (26) being mounted at least partially about the tool body (24);

iii. a data acquisition module 22 disposed proximate the tool body (24) and operatively connected to the power source (26); and iv. a non-controlling wireless data transceiver (57) communicatively coupled to the data acquisition module 22 and a transmission medium (12) for data transmission through the transmission medium (12); and c. a data transceiver (55) located remotely from the wireless tool (20), the data transceiver (55) communicatively coupled to the wireless tool (20) via the transmission medium (12).

2. The system of claim 1 wherein data may be transmitted though the transmission medium (12) in either a broadband or single channel mode.

3. The system of claim 1 wherein the wireless transmission medium (12) comprises at least one of an acoustical signaling medium, an optical signaling medium, and an electromechanical signaling medium.

4. The system of claim 3 wherein the electrical signaling medium comprises a wellbore pipe (14) used as a transmission medium (14).

5. The system of claim 4 where the wireless transmission medium (12) further comprises at least one of drilling mud and production fluid.

6. The system of claim 1 wherein data transmission comprises EMF signaling, acoustic wave signaling, and acoustic stress wave signaling using wellbore tubing as a transmission medium.

7. The system of claim 1 further comprising a gauge (30) operatively in communication with the wireless tool (20).

8. The system of claim 7 wherein the gauge (30) draws power from the wireless tool (20) power source (26).

9. The system of claim 7 wherein the gauge (30) is permanently deployed in a lower completion section (10*a*, 10*b*) of the wellbore (10).

10. The system of claim 1 further comprising power generation devices located downhole, the power generation devices comprising at least one of a piezoelectric power generation device, a magneto-restrictive power generation device, a turbine, a removable power source that is replaceable downhole, and a battery (26).

11. The system of claim 1 wherein the wireless tool (20) further comprises at least one of a pressure sensor (30), a temperature sensor (30), a fluid flow sensor (30), a fluid identification sensor (30), a resistivity sensor (30), a cross-well acoustics sensor (30), a cross-well seismic sensor (30), a perforation depth sensor (30), a fluid characteristics sensor (30), a logging data sensor (30), a strain gauge (30) and a vibration sensor (30).

12. A method of wireless transmission of data within a well (10), comprising:

a. deploying a wireless tool (20) downhole, the wireless tool (20) comprising a wireless data transceiver (57) adapted to receive data and commands from and transmit data and commands to a remote data transceiver (55) located remotely from the wireless tool (20);

b. obtaining data regarding at least one predetermined downhole parameter;

c. gathering the data at the wireless tool (20);

d. establishing wireless data communications between the wireless tool (20) and the data receiver (55) though a wireless transmission medium (14);

e. wirelessly transmitting the data between the wireless data transceiver (57) and the remote data transceiver (55), the wireless data communication comprising a collision detection protocol;

f. retrieving the data at the remote data transceiver (55); and g. processing the data in a data processor (60) operatively in communication with the remote data transceiver (55) according to predetermined programming.

13. The method of claim 12 wherein:

a. the wireless data communications comprises at least one of (i) one way and (ii) two way communications for down link and uplink capability; and b. the two way communications comprises master/slave data communications wherein the remote data transceiver (55) is located at a surface of the well (10) and acts as the master.

14. The method of claim 12 wherein:

a. step (g) further comprises processing the data according to the predetermined programming to control flow of hydrocarbons from an annulus of the well (10) into production tubing (14); and b. the data comprise physical parameter data describing at least a portion of a downhole environment and data describing the health of at least one tool located downhole.

15. The method of claim 14 further comprising:

a. using the data in the data processor (60) to control flow of fluids and solids from the surface downhole into the well (10); and b. using the data in the data processor (60) to control flow of fluids and solids from a first portion of the well (10) downhole to another portion of the well (10) downhole.

16. The method of claim 15 wherein using the data in the data processor (60) to control flow of fluids and solids from a first portion of the well (10) downhole to another portion of the well (10) downhole is used for bit cutting injection or fluid injection.

17. The method of claim 12 wherein:

a. the data processor (60) comprises a control system (60) located at least partially at the surface for controlling flow of hydrocarbon from the annulus of the well (10) into production tubing (14), wherein step (f) further comprises:

i. processing the data according to supervisory control and data acquisition (SCADA) programming; and ii. transmitting data to be received by a device located downhole based at least partially on the data obtained from the wireless tool (20) to aid in production of hydrocarbons;

b. the transmitted data of step (f)(ii) comprise at least one of control directives to start data transmission to the surface, control directives to wake up the tool, and control directives to change a predetermined operating parameter in the tool (20);

c. the change in operating parameter comprises control directives to optimize hydrocarbon production from the well; and d. the method further comprises issuing a directive to shut down at least one device located downhole by the data processor (60) to manage power inside the wellbore in response to data received by the control system (60).

18. The method of claim 17 further comprising issuing a directive to shut down at least one device located downhole by the data processor (60) to manage power inside the wellbore in response to data received by the control system (60), wherein the data further comprise build up and draw down test result data.

19. The method of claim 12 wherein the data processor (60) comprises a control system (60) located at least partially at the surface for controlling flow of hydrocarbon from the annulus of the well (10) into production tubing (14), wherein step (f) further comprises:

a. processing the data according to supervisory control and data acquisition (SCADA) programming; and b. transmitting data to be received by a device located downhole based at least partially on the data obtained from the wireless tool (20) to aid in production of hydrocarbons, the data comprising data reflective of monitoring and testing of inflation of an external casing packer whereby the SCADA (60) system may monitor curing of cement and proper sealing of the external casing packer.

20. The method of claim 12 further comprising an artificial lift pump deployed downhole and a sensor (30) capable of sensing conditions of the artificial lift pump, the sensor (30) operatively in communication with the wireless tool (20), the wireless tool (20) further capable of transmitting control data to the artificial lift pump, wherein the data in step (c) comprises data useful for monitoring and controlling the artificial lift pump.

21. The method of claim 20 further comprising issuing control directives from the data processor (60) for the artificial lift pump based at least partially on the data gathered by the wireless tool (20).

22. The method of claim 20 wherein the data useful for monitoring and controlling artificial lift pumps comprises sensed data useful in determining at least one of the conditions of whether the artificial lift pump is functioning properly, of bearings in the artificial lift pump, of temperature characteristics of the artificial lift pump, and of the occlusion of the artificial lift pump.

23. The method of claim 12, further comprising:

a. placing the tool in a work string for well re-work; and b. retrieving the tool from the well once the re-work is completed.

24. The method of claim 23 wherein the re-work comprises temporary applications for drill stem testing.

25. The method of claim 12 further comprising a. placing the tool in a work string for fracture jobs and mini-fracture jobs; and b. retrieving the tool from the well once the fracture job or mini-fracture job is completed.

26. The method of claim 12 further comprising a. placing the tool in a work string for gravel pack services to optimize the gravel pack process; and b. retrieving the tool from the well once the gravel pack services are is completed.

27. The method of claim 12 wherein step (a) further comprises positioning the wireless tool (20) in a liner (16) of a permanently completed well (10).

28. The method of claim 25 wherein the wireless tool (20) is used to monitor pressure drop throughout the liner (16).

29. The method of claim 12 where step (g) further comprises issuing control directives from the data processor (60) to control injection of fluids and solids into the annulus or geological formations associated with the well (10) based at least partially on the data obtained from the wireless tool (20).

* * * * *